US008263010B2

(12) United States Patent
Brunel

(10) Patent No.: US 8,263,010 B2
(45) Date of Patent: Sep. 11, 2012

(54) DEVICE FOR REMOVING POLLUTANTS FROM THE EXHAUST GASES OF A HEAT ENGINE

(75) Inventor: Jean-Paul Brunel, Meslieres (FR)

(73) Assignee: Faurecia Systemes d'Echappement, Nanterre (FR)

( * ) Notice: Subject to any disclaimer, the term of this patent is extended or adjusted under 35 U.S.C. 154(b) by 349 days.

(21) Appl. No.: 12/304,348

(22) PCT Filed: Jun. 12, 2007

(86) PCT No.: PCT/FR2007/000969

§ 371 (c)(1),
(2), (4) Date: Jun. 5, 2009

(87) PCT Pub. No.: WO2007/144500

PCT Pub. Date: Dec. 21, 2007

(65) Prior Publication Data

US 2009/0280039 A1 Nov. 12, 2009

(30) Foreign Application Priority Data

Jun. 12, 2006 (FR) ..... 06 05206

(51) Int. Cl.
*B01D 50/00* (2006.01)

(52) U.S. Cl. ..... 422/180; 422/179

(58) Field of Classification Search ..... 422/177, 422/179, 180

See application file for complete search history.

(56) References Cited

U.S. PATENT DOCUMENTS 3,854,888 A * 12/1974 Frietzsche et al. ..... 422/171
4,039,291 A * 8/1977 Hergoualc'h et al. ..... 422/179
4,235,846 A 11/1980 Abthoff et al.
5,173,267 A * 12/1992 Maus et al. ..... 422/179

FOREIGN PATENT DOCUMENTS

FR 2 284 028 4/1976
FR 2 825 117 11/2002
WO WO 2006061526 A1 * 6/2006

OTHER PUBLICATIONS

International Search Report dated Sep. 25, 2007, from corresponding to PCT application.

* cited by examiner

*Primary Examiner* — Tom Duong
(74) *Attorney, Agent, or Firm* — Young & Thompson

(57) ABSTRACT

A device for removing pollutants from exhaust gases of a combustion engine, includes a longitudinal outer casing (23) defining a passage through which the exhaust gases flow, and first and second pollution-removal members (18, 20) mounted in series in the passage. The device includes a holding sleeve (38) holding the first pollution-removal member (18) in place and interposed between the first pollution-removal member (18) and the outer casing (23) and running longitudinally at least over most of the length of the first pollution-removal member (18), the holding sleeve (38) being guided in the external casing (23) and forming, between the first and second pollution-removal members (18, 20) a longitudinal thrust surface (40) against which the first pollution-removal member (18) bears.

18 Claims, 2 Drawing Sheets

DEVICE FOR REMOVING POLLUTANTS FROM THE EXHAUST GASES OF A HEAT ENGINE

BACKGROUND OF THE INVENTION

The invention relates in general to a device for removing pollution from the exhaust gases of a heat engine.

To be more precise, the invention relates to a device for removing pollution from the exhaust gases of a heat engine, of the type comprising a longitudinal outer casing defining a passage for the flow of the exhaust gases, and first and second pollution-removal members mounted in series in the passage.

Such a device is used in particular for removing pollution from diesel engines of motor vehicles. In that case it normally comprises, located in the same casing, a catalytic purification member and a particle filter. The catalytic purification member is suitable for treating the polluting emissions in gaseous phase, while the particle filter is suitable for retaining the soot particles emitted by the engine and optionally for fixing the gaseous pollutants.

In devices for petrol engines, several catalytic purification members are located in the same casing.

In some cases, one of the two pollution-removal members may have a small thickness compared with its diameter. Such a pollution-removal member is difficult to position inside the casing. In particular, it is difficult to obtain a situation where the upstream and downstream faces of the pollution-removal member are in an orientation perpendicular to the longitudinal axis of the casing.

SUMMARY OF THE INVENTION

In this context, the object of the invention is to propose a device for removing pollution from exhaust gases, in which device the positioning of a pollution-removal member of small thickness is facilitated.

To that end, the invention relates to a device for removing pollution from exhaust gases of the above-mentioned type, characterised in that it comprises a sleeve for holding the first pollution-removal member, which sleeve is interposed between the first pollution-removal member and the outer casing and extends longitudinally at least over most of the length of the first pollution-removal member, the holding sleeve being guided in the outer casing and forming between the first and second pollution-removal members a surface for longitudinal abutment against which the first pollution-removal member bears.

The device may also have one or more of the following features, considered individually or in any technically possible combination:

- the outer casing comprises a cylindrical wall in which the first and second pollution-removal members are placed, and a divergent portion rigidly secured to the cylindrical wall;
- the holding sleeve forms two surfaces for longitudinal abutment, one on each side of the first pollution-removal member, the first pollution-removal member bearing against the two abutment surfaces;
- the divergent portion forms a peripheral shoulder on the opposite side to the second pollution-removal member relative to the first pollution-removal member, the first pollution-removal member bearing longitudinally against the peripheral shoulder and against the abutment surface;

- the cylindrical wall and the divergent portion of the outer casing comprise respective free edges which face each other and which are welded to each other and to the holding sleeve;
- the divergent portion forms a female end in which a male end of the cylindrical wall is engaged;
- the cylindrical wall forms a female end in which a male end of the divergent portion is engaged, a peripheral edge of the holding sleeve being gripped between the male and female ends and welded to the male and female ends;
- the holding sleeve is a piece of open rolled sheet-metal;
- the holding sleeve is a piece of rolled sheet-metal having two parallel edges secured rigidly to each other; and
- the first pollution-removal member has a longitudinal thickness smaller than half its largest dimension in a transverse plane.

BRIEF DESCRIPTION OF THE DRAWINGS

Other features and advantages of the invention will emerge from the description thereof given hereinafter by way of non-limiting example with reference to the appended Figures, of which.

DETAILED DESCRIPTION OF THE PREFERRED EMBODIMENTS

Figure 1:
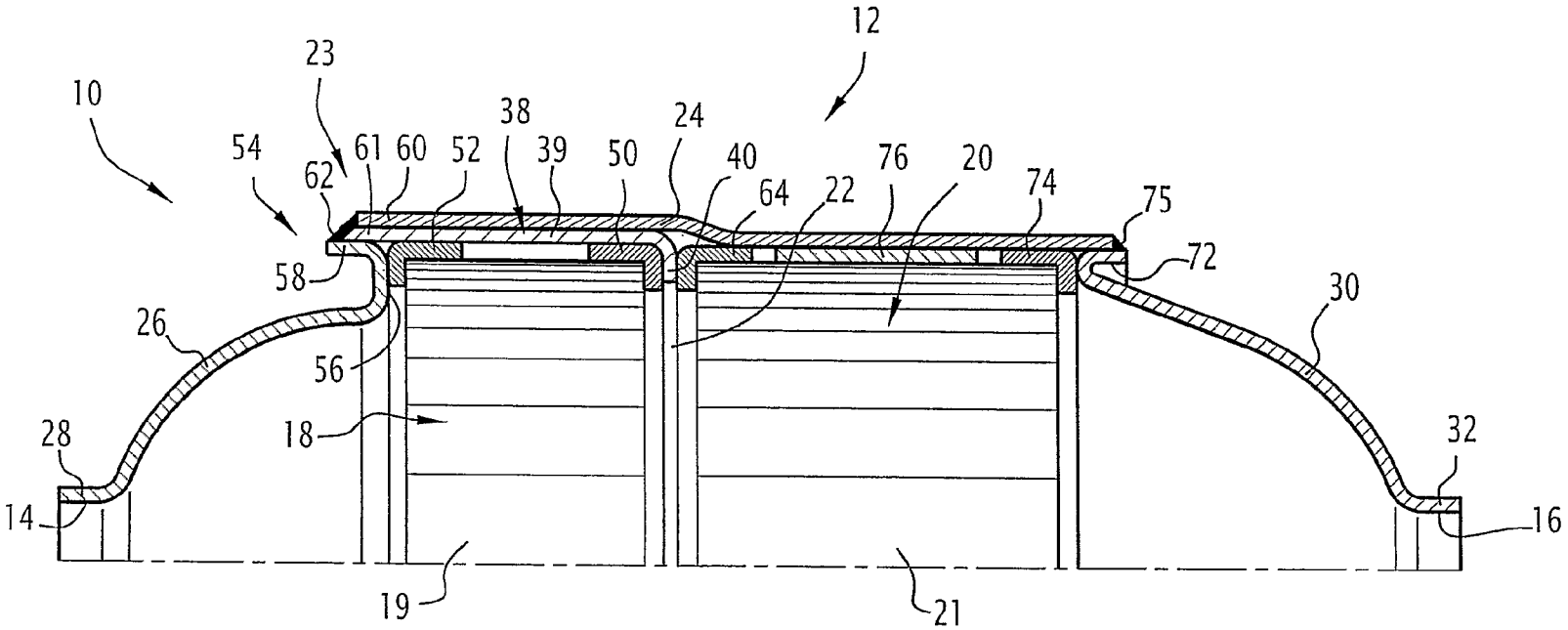
FIG. 1 is a longitudinal half-section through a pollution-removal device according to a first embodiment of the invention.

The pollution-removal device 10 shown in FIG. 1 comprises a generally cylindrical exhaust silencer 12 having, at one end, an inlet 14 and, at its other end, an outlet 16. A catalytic purification member 18 and a particle filter 20 which are separated by a free transition space 22 are located in succession from the inlet to the outlet inside the silencer 12.

The exhaust silencer 12 comprises a longitudinal outer casing 23 delimiting a passage for the flow of the exhaust gases through which passage the catalytic purification member 18 and the particle filter 20 are put in position.

The catalytic purification member 18 comprises, for example, a gas-permeable structure 19 covered with catalytic metals promoting the oxidation of the combustion gases and/or the reduction of the nitrogen oxides.

The particle filter 20 comprises a filtration material formed by a monolithic structure 21 of ceramics or of silicon carbide having a porosity sufficient to permit the passage of the exhaust gases. However, as known per se, the diameter of the pores is selected to be sufficiently small to ensure that the particles, and especially the soot particles, are retained on the upstream face of the filter. The particle filter may also be produced from a ceramic foam, cordierite or silicon carbide. It may also be in the form of a cartridge filter or a sintered metal filter.

The particle filter used here comprises, for example, a set of parallel ducts divided into a first group of inlet ducts and a second group of outlet ducts. The inlet and outlet ducts are in an alternating arrangement.

The inlet ducts open into the upstream section of the particle filter and are closed off in the region of the downstream section of the particle filter.

In contrast, the outlet ducts are closed off at the upstream section of the particle filter and open into the downstream section thereof.

In its linear portion, the outer casing 23 is formed by a cylindrical wall 24 having a substantially constant cross-section.

The outer casing 23 also comprises a divergent portion 26 connecting an inlet tube 28 to the cylindrical wall 24. The tube 28 defines the inlet 14. Likewise, at its rear end, the cylindrical wall 24 is extended by a convergent portion 30 terminating in an outlet tube 32 delimiting the outlet 16.

In operation, the exhaust gases flow longitudinally first through the catalytic purification member 18 and then through the particle filter 20.

In the text below, the terms upstream and downstream will be considered in relation to the normal direction of flow of the exhaust gases.

The pollution-removal device 10 comprises a cylindrical sleeve 38 inside which the catalytic purification member 18 is accommodated in its entirety.

The sleeve 38 comprises a longitudinal ring 39 and a reentrant collar 40 formed at the downstream longitudinal end of the ring 39. The collar 40 forms a surface for longitudinal abutment against which the catalytic pollution-removal member 18 bears.

In addition to the gas-permeable structure 19, the catalytic purification member 18 comprises a shim 50 interposed between the periphery of the downstream face of the structure 19 and the collar 40. This shim extends along the lateral wall of the structure 19.

The shim 50 is formed by an annular seal having in cross-section the general shape of an L, one branch of which bears on the collar 40 and the other branch of which bears on the ring 39 of the sleeve 38.

A shim 52, identical to the shim 50, is engaged at the periphery of the upstream face of the structure 19 and it, too, extends partially along the lateral surface of the structure. The branch of the shim covering, at its periphery, the upstream surface forms a seat for bearing against the divergent portion 26. The branch covering the lateral surface of the structure 19 bears on the ring 39. The divergent portion 26 has a peripheral edge 54 for securing to the cylindrical wall 24, forming a U-shaped turned-back portion. This edge 54 has a central portion 56 having an orientation substantially perpendicular to the longitudinal direction and forming a peripheral shoulder against which the catalytic purification member 18 bears.

The branch of the shim 52 covering the periphery of the upstream face of the structure 19 bears against the shoulder 56.

The edge 54 also comprises a cylindrical free portion 58 which has a longitudinal orientation and which extends the shoulder 56 away from the catalytic purification member 18. The cylindrical portion 58 forms a male end engaged in a female end formed by the upstream peripheral edge 60 of the cylindrical wall 24.

The sleeve 38 is engaged by its upstream end 61 between the cylindrical portion 58 and the peripheral edge 60. A single peripheral weld 62 fixedly joins the sleeve 38, the edge 60 and the cylindrical portion 58.

The two shims 50, 52 define an axial clearance between the shoulder 56 and the upstream face of the substrate 19 which is of the order of 5.5 mm while the radial clearance defined between the lateral surfaces opposite the substrate 19 and the sleeve 38 is of the order of 3.5 mm.

These two shims are formed by a metal lattice of the type ACS LSP 5600 supplied by the company ACS. Only the upstream shim 52 is associated with a heat-expandable material of the vermiculite type which provides a seal against the exhaust gases.

The substrate 21 of the particle filter bears via its upstream face on the collar 40 with the interposition of a shim 64 formed by an annular seal having an L-shaped cross-section, one branch of which is interposed between the collar 40 and the periphery of the upstream face of the substrate 21 and the other wing of which extends between the lateral wall of the substrate and the cylindrical wall 24.

The widened end of the convergent portion 30 is inserted into the downstream end of the wall 24. For that purpose, it has a generally cylindrical outer rim 72 suitable for fitting against the inner surface of the wall 24. The convergent portion 30 bears against the substrate 21 of the particle filter with the interposition of a shim 74 formed by a seal identical to the shim 64. A peripheral weld 75 fixedly joins the rim 72 and the wall 24.

The shims 64 and 74 define an axial clearance of the order of 5 mm and a radial clearance of the order of 3.5 mm.

The shims are, for example, of the type LSP-5600.45 supplied by the company ACS. They differ from the shims 50 and 52 inasmuch as they are denser in order better to absorb the stresses of the particle filter 20.

Furthermore, the substrate 21 is surrounded in its linear portion by a holding mat 76 interposed between the substrate and the inner surface of the portion 40. This mat is formed, for example, by ISOMAT AV 3280 g/m$^2$ supplied by the company Unifrax.

The catalytic purification member 18 has a small longitudinal length compared with its transverse dimensions. Thus, the longitudinal length of the substrate 19 is smaller than 0.5 times its largest dimension in a transverse direction. Preferably, the longitudinal length of the substrate 19 is from 0.2 to 0.4 times its largest dimension in a transverse direction and is, for example, 0.3 times that largest dimension. The substrate 19 typically has a cylindrical shape, so that its largest dimension in a transverse direction corresponds to its diameter.

In a variant, the catalytic purification member 18 may comprise a peripheral holding mat around the substrate 19, between the shims 50 and 52.

The sleeve 38 is typically a piece of rolled sheet-metal. This piece of sheet-metal is curved, at one of its longitudinal ends, or at its two longitudinal ends, in such a manner as to form the reentrant collar(s).

The sleeve 38 may remain open, in which case the two parallel longitudinal edges of the piece of rolled sheet-metal are not secured to each other and remain free. The sleeve may also be closed, in which case the two longitudinal parallel edges of the piece of rolled sheet-metal are secured rigidly to each other. The two edges may be secured to each other by weld spots, or by form-fitting, for example by means of a dovetail device or a tenon and mortise device. The two longitudinal edges may be separate or may cover each other, totally or partially. In this latter case, one of the longitudinal edges comprises a circumferential tongue covering the other edge.

In a variant, the sleeve 38 may be produced from a piece of thin sheet-metal having a thickness of less than 1 mm, preferably from 0.2 to 0.6 mm. This thickness is, for example, 0.4 mm.

For assembly, the catalytic purification member 18 is first of all engaged inside the sleeve 38, the shims 50 and 52 being interposed between the substrate 19 and the sleeve 38. This operation can be carried out, for example, by the substrate supplier or, otherwise, in the workshop for mounting the exhaust silencer.

The substrate 21 of the particle filter is then engaged with the two shims 64, 74 in the cylindrical wall 24. The convergent portion 30 is inserted into the wall 24 from the downstream end and the weld 75 for securing the wall 24 to the convergent portion 30 is produced. The assembly formed by the sleeve 38 and the catalytic purification member 18 is then fitted into the cylindrical wall 24 via the upstream side. This assembly is pushed in until it abuts the shim 64 via the collar 40. Owing to the fact that the sleeve 38 has a cylindrical shape with an outside diameter corresponding nominally to the inside diameter of the upstream portion of the wall 24, it is guided when it is put in place in the cylindrical wall 24. As a result, the positioning of the sleeve 38, and therefore of the purification member 18, is very precise. In particular, the orientation of the upstream and downstream faces of the substrate 19 is absolutely perpendicular to the longitudinal direction.

Finally, the divergent portion 26 is inserted into the upstream peripheral edge 60 of the wall 24. The shoulder 56 bears against the purification member 18. The member 18 is thus urged against the collar 40, the latter in turn urging the particle filter 20 against the convergent portion 30. Thus, the particle filter 20 is kept clamped between the collar 40 and the rim of the convergent portion 30. The substrate 21 is held with a compressive force of 4000 N imposed by the convergent portion 30 and the divergent portion 26.

The compression of the catalytic purification member 18 between the shoulder 56 and the collar 40 is monitored and adjusted in accordance with the stresses by altering the insertion force applied to the divergent portion 26. This force is preferably from 1500 to 5000 N and is, for example, of the order of 2000 N.

Several other embodiments of the invention will now be described. Elements identical to those of the first embodiment, or playing the same role, are denoted by the same references.

Figure 2:
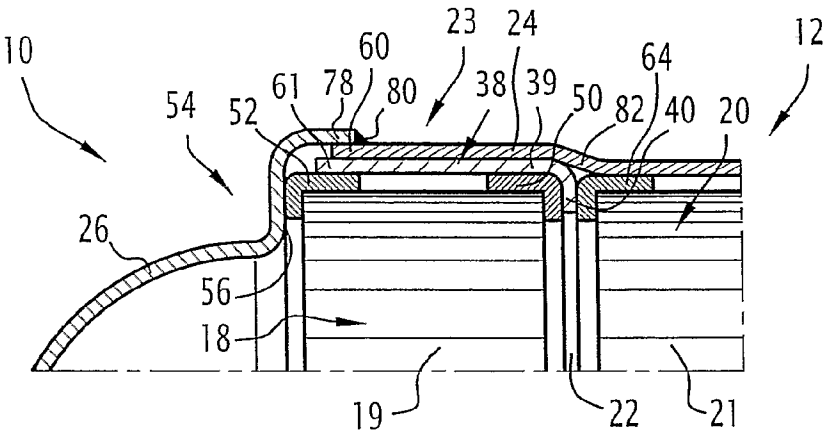
FIG. 2 is a longitudinal section through a portion of a pollution-removal device according to a second embodiment of the invention.

A second embodiment of the invention is shown in FIG. 2. Only the differences relative to the first embodiment will be described below.

As shown in FIG. 2, the substrate 19 is not accommodated completely inside the sleeve 38 but the latter nevertheless extends over most of the longitudinal length of the catalytic purification member 18. The upstream face of the substrate 19 is located slightly outside the upstream end 61 of the sleeve.

In addition, the peripheral edge 54 of the divergent portion no longer forms a U-shaped turned-back portion. The edge 54 still has a central portion 56 of transverse orientation forming a peripheral shoulder against which the catalytic purification member 18 bears. The portion 56 extends longitudinally to the cylindrical wall 24 via a cylindrical free portion 78 of longitudinal orientation. The cylindrical portion 78 forms a female end into which a male end formed by the upstream peripheral edge 60 of the cylindrical wall 24 is inserted. A peripheral weld 80 fixedly joins the portion 78 and the edge 60.

In the second embodiment, the sleeve 38 is welded neither to the cylindrical wall 24 nor to the divergent portion 26.

A shoulder 82 is formed in the cylindrical wall 24, substantially at right-angles to the free transition space 22. The shoulder 82 forms, inside the wall 24, a peripheral surface for the longitudinal bearing of the sleeve 38.

The assembly of the exhaust silencer 12 is effected in accordance with the procedure below.

As before, the catalytic purification member 18 is first of all engaged inside the sleeve 38, the shims 50 and 52 being interposed between the substrate 19 and the sleeve 38. This assembly is then engaged in the cylindrical wall 24 via the upstream side until the sleeve 38 abuts the shoulder 82 of the cylindrical wall 24. Subsequently, the cylindrical wall 24 is inserted into the peripheral edge 54 for securing the divergent portion. The compression of the catalytic purification member 18 between the shoulder 56, on the one hand, and the collar 40, which itself bears on the shoulder 82, on the other hand, is monitored and adjusted in accordance with the stresses. The weld 80 for fixedly joining the cylindrical wall 24 and the divergent portion 26 is then produced.

Finally, the particle filter 20 is fitted in the cylindrical wall 24 via the downstream side, and the convergent portion 30 is inserted into the wall 24 from the downstream end. The compression of the particle filter 20 is adjusted by the force used to fit the convergent portion 30. Finally, the weld 75 for securing the wall 24 to the convergent portion 30 is produced.

As before, the sleeve 38 is guided during its insertion into the cylindrical wall 24 owing to the fact that the outside diameter of the sleeve 38 corresponds to the inside diameter of the upstream portion of the cylindrical wall. The catalytic purification member 18 is thus positioned and oriented with precision.

In a variant, the particle filter does not comprise a shim 64 and does not bear on the collar 40. Owing to the fact that the sleeve 38 bears against the shoulder 82, this shim is not indispensable.

A third embodiment will now be described with reference to FIG. 3.

This third embodiment is very similar to the second embodiment except for the following points.

Figure 3:
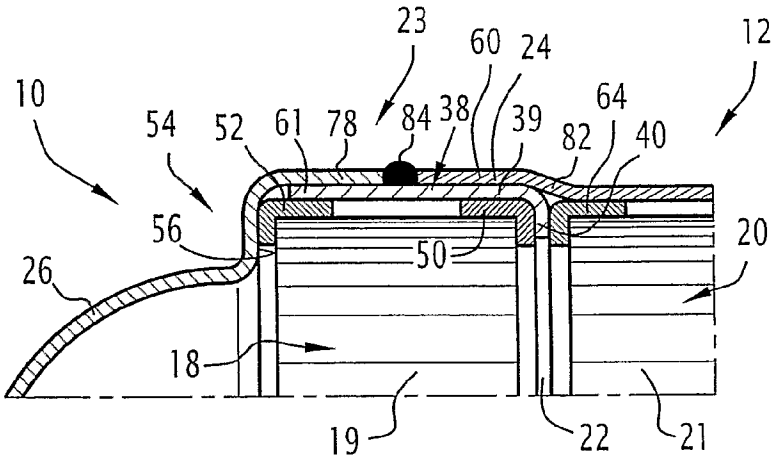
FIGS. 3 and 4 are views similar to that of FIG. 2 for two other embodiments of the invention.

As shown in FIG. 3, the upstream peripheral edge 60 of the cylindrical wall 24 is not inserted into the cylindrical free portion 78 of the divergent portion. Instead, the cylindrical free portion 78 and the edge 60 have the same diameter and are located at a small distance from and opposite each other.

They are both placed on an outer face of the sleeve 38. A single continuous weld bead 84 fixedly joins the edge 60 to the cylindrical free portion 78. The weld bead 84 also fixedly joins the edge 60 and the portion 78 to the sleeve 38.

The assembly of the exhaust silencer is effected in accordance with the same procedure as for the second embodiment.

A fourth embodiment will now be described with reference to FIG. 4.

This fourth embodiment is similar to the third, except for the following differences.

Figure 4:
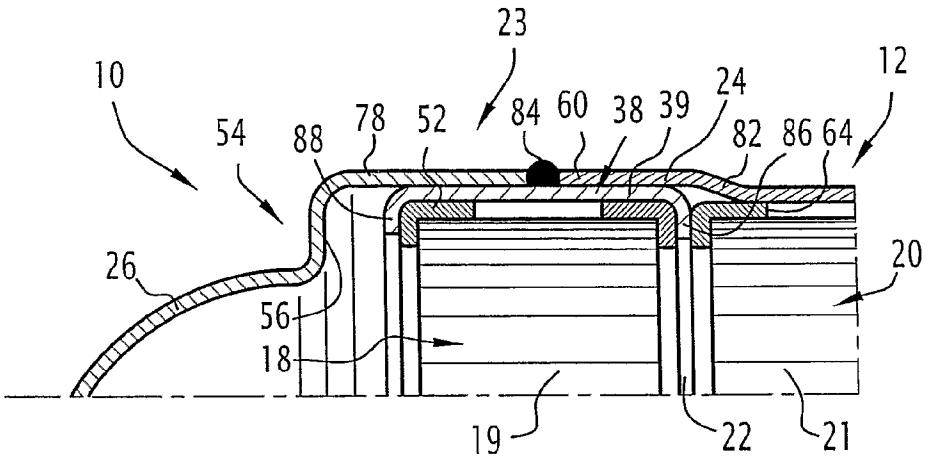

As shown in FIG. 4, the sleeve 38 forms, one on each side of the catalytic purification member 18, reentrant collars 86 and 88, forming surfaces for longitudinal abutment against which the catalytic purification member 18 bears. The branch of the seal 52 covering the periphery of the upstream face of the substrate 19 bears against the collar 88. Likewise, the branch of the seal 50 covering the periphery of the downstream face of the substrate 19 bears against the collar 86.

The collar 88 is located longitudinally at a distance from the shoulder 56 formed on the divergent portion 26. Likewise, the collar 86 is located longitudinally at a distance from the shoulder 82 formed in the cylindrical wall 24.

As in the third embodiment, the weld bead 84 fixedly joins the cylindrical portion 78 of the edge 54 to the peripheral edge 60, and fixedly joins the portion 78 and the edge 60 to the sleeve 38.

The assembly of the exhaust silencer is effected in accordance with the following procedure.

The catalytic purification member 18 is first of all arranged inside the sleeve 38. The shims 50 and 52 are interposed between the substrate 19 and the sleeve 38. The compression of the catalytic purification member is adjusted during the mounting operation by adjusting the spacing between the collars 86 and 88 by any suitable means. The particle filter 20 is then fitted inside the cylindrical wall 24, and the convergent portion 30 is inserted into the wall 24 from the downstream end. The weld 75 for securing the wall 24 to the portion 30 is then produced.

The assembly formed by the sleeve 38 and the catalytic purification member 18 is then fitted in the cylindrical wall 24 via the upstream side. The compression of the particle filter 20 is adjusted by altering the force used to fit the assembly. The assembly sleeve 38/member 18 is kept in place by producing a few weld spots between the peripheral edge 60 of the cylindrical wall 24 and the sleeve 38. The divergent portion 26 is then fitted around the sleeve 38, and the continuous weld bead 84 is produced with a view to securing the wall 24, the divergent portion 26 and the sleeve 38 to one another.

Thus, in the fourth embodiment, the substrate 19 of the catalytic purification member is compressed by the collars 86 and 88 of the sleeve 38. In the first three embodiments, the substrate 19 is compressed by the collar 40 of the sleeve co-operating for this purpose with the shoulder 56.

The invention has been described in the case where the catalytic purification member 18 has a small length compared with its transverse dimensions. However, it is possible for it not to be the catalytic purification member 18 which has a small length but, rather, the particle filter 20. In that case, it is the particle filter 20 which is accommodated in the sleeve 38. Furthermore, it is also possible for the catalytic purification member 18 and the particle filter 20 both to have simultaneously a small longitudinal length compared with their transverse dimensions. In that case, the two pollution-removal members are each located inside a sleeve 38 accommodated in the cylindrical wall 24.

It will be appreciated that the use of an inner sleeve facilitates the positioning and orientation of the catalytic purification member 18 without having too adverse an effect on the amount of material used.

For, owing to the fact that the member 18 is short longitudinally, the sleeve 38, too, is longitudinally short. It is therefore inexpensive in terms of material.

In addition, a single weld bead enables the sleeve 38 to be secured to the wall 24 and to the divergent portion 26, and the wall 24 to be secured to the portion 26. This also helps to reduce the cost of the pollution-removal device.

The invention claimed is:

1. A device for removing pollution from the exhaust gases of a heat engine, comprising:

a longitudinal outer casing (23) delimiting a passage for the flow of the exhaust gases;

first and second pollution-removal members (18, 20) mounted in series in the passage; and a holding sleeve (38) for holding the first pollution-removal member (18), said holding sleeve (38) being interposed between the first pollution-removal member (18) and the outer casing (23) and extending longitudinally at least over most of the length of the first pollution-removal member (18), the holding sleeve (38) being guided in the outer casing (23) and forming between the first and second pollution-removal members (18, 20) a surface (40, 86) for longitudinal abutment against which the first pollution-removal member (18) bears, wherein the outer casing (23) comprises i) a cylindrical wall (24) in which the first and second pollution-removal members (18, 20) are placed, and ii) a divergent portion (26) rigidly secured to the cylindrical wall (24), and wherein the cylindrical wall (24) and the divergent portion (26) comprise respective free edges (60, 78) which face each other and which are welded to each other and to the holding sleeve (38).

2. The device according to claim 1, wherein the divergent portion connects an inlet tube to the cylindrical wall of the outer casing, the inlet tube defining an exhaust gas inlet into the outer casing, the divergent portion having a section which increases from the inlet tube to the cylindrical wall.

3. The device for removing pollution according to claim 1, wherein the holding sleeve (38) forms two surfaces (86, 88) for longitudinal abutment, one on each side of the first pollution-removal member (18), the first pollution-removal member (18) bearing against the two abutment surfaces (86, 88).

4. The device for removing pollution according to claim 1, wherein the holding sleeve (38) is a piece of open rolled sheet-metal.

5. The device for removing pollution according to claim 1, wherein the holding sleeve (38) is a piece of rolled sheet-metal having two parallel edges secured rigidly to each other.

6. The device for removing pollution according to claim 1, wherein the first pollution-removal member (18) has a longitudinal thickness smaller than half its largest dimension in a transverse plane.

7. A device for removing pollution from the exhaust gases of a heat engine, comprising:

a longitudinal outer casing (23) delimiting a passage for the flow of the exhaust gases;

first and second pollution-removal members (18, 20) mounted in series in the passage; and a holding sleeve (38) for holding the first pollution-removal member (18), said holding sleeve (38) being interposed between the first pollution-removal member (18) and the outer casing (23) and extending longitudinally at least over most of the length of the first pollution-removal member (18), the holding sleeve (38) being guided in the outer casing (23) and forming between the first and second pollution-removal members (18, 20) an abutment surface (40, 86) for longitudinal abutment against which the first pollution-removal member (18) bears, wherein the outer casing (23) comprises i) a cylindrical wall (24) in which the first and second pollution-removal members (18, 20) are placed, and ii) a divergent portion (26) rigidly secured to the cylindrical wall (24), wherein the divergent portion (26) forms a peripheral shoulder (56) on an opposite side to the second pollution-removal member (20) relative to the first pollution-removal member (18), a front face of the first pollution-removal member being turned longitudinally toward the peripheral shoulder, the first pollution-removal member (18) being compressed longitudinally between the peripheral shoulder (56) and the abutment surface (40), without the holding sleeve (38) being interposed between said front face and said peripheral shoulder (56).

8. The device according to claim 7, wherein the divergent portion connects an inlet tube to the cylindrical wall of the outer casing, the inlet tube defining an exhaust gas inlet into the outer casing, the divergent portion having a section which increases from the inlet tube to the cylindrical wall.

9. The device according to claim 7, wherein the front face of the first pollution-removal member (18) bears against the peripheral shoulder (56) only via a shim.

10. The device for removing pollution according to claim 7, wherein the divergent portion (26) forms a female end (78) in which a male end (60) of the cylindrical wall (24) is engaged.

11. The device for removing pollution according to claim 7, wherein the holding sleeve (38) is a piece of open rolled sheet-metal.

12. The device for removing pollution according to claim 7, wherein the holding sleeve (38) is a piece of rolled sheet-metal having two parallel edges secured rigidly to each other.

13. The device for removing pollution according to claim 7, wherein the first pollution-removal member (18) has a longitudinal thickness smaller than half its largest dimension in a transverse plane.

14. A device for removing pollution from the exhaust gases of a heat engine, comprising:

a longitudinal outer casing (23) delimiting a passage for the flow of the exhaust gases;

first and second pollution-removal members (18, 20) mounted in series in the passage; and a holding sleeve (38) for holding the first pollution-removal member (18), said holding sleeve (38) being interposed between the first pollution-removal member (18) and the outer casing (23) and extending longitudinally at least over most of the length of the first pollution-removal member (18), the holding sleeve (38) being guided in the outer casing (23) and forming between the first and second pollution-removal members (18, 20) a surface (40, 86) for longitudinal abutment against which the first pollution-removal member (18) bears, wherein the outer casing (23) comprises i) a cylindrical wall (24) in which the first and second pollution-removal members (18, 20) are placed, and ii) a divergent portion (26) rigidly secured to the cylindrical wall (24), and wherein the cylindrical wall (24) forms a female end (60) in which a male end (58) of the divergent portion (26) is engaged, a peripheral edge (61) of the holding sleeve (38) being gripped between the male and female ends (58, 60) and welded to the male and female ends (58, 60).

15. The device according to claim 14, wherein the divergent portion connects an inlet tube to the cylindrical wall of the outer casing, the inlet tube defining an exhaust gas inlet into the outer casing, the divergent portion having a section which increases from the inlet tube to the cylindrical wall.

16. The device for removing pollution according to claim 14, wherein the holding sleeve (38) is a piece of open rolled sheet-metal.

17. The device for removing pollution according to claim 14, wherein the holding sleeve (38) is a piece of rolled sheet-metal having two parallel edges secured rigidly to each other.

18. The device for removing pollution according to claim 14, wherein the first pollution-removal member (18) has a longitudinal thickness smaller than half its largest dimension in a transverse plane.

* * * * *